US007219709B1

(12) United States Patent
Williams

(10) Patent No.: US 7,219,709 B1
(45) Date of Patent: May 22, 2007

(54) RETRACTABLE GATE

(76) Inventor: John Williams, 2626 Rio Grande, Punta Gorda, FL (US) 33950

( * ) Notice: Subject to any disclaimer, the term of this patent is extended or adjusted under 35 U.S.C. 154(b) by 304 days.

(21) Appl. No.: 11/044,666

(22) Filed: Jan. 27, 2005

(51) Int. Cl.
*A47H 1/00* (2006.01)

(52) U.S. Cl. ..... 160/24; 160/302

(58) Field of Classification Search ..... 160/24, 160/303, 290.1, 300, 301, 302, 309, 370.22, 160/23.1, 264
See application file for complete search history.

(56) References Cited

U.S. PATENT DOCUMENTS

| | | | | | |
|---|---|---|---|---|---|
| 311,044 | A * | 1/1885 | Tarney | 160/262 |
| 746,403 | A * | 12/1903 | Tarney | 160/290.1 |
| 832,335 | A * | 10/1906 | McDonald | 160/264 |
| 1,216,794 | A * | 2/1917 | Garman | 160/31 |
| 1,324,421 | A * | 12/1919 | Biasucci | 160/300 |
| 1,417,104 | A * | 5/1922 | Pachesa | 160/27 |
| 1,608,667 | A * | 11/1926 | Poetsch | 160/23.1 |
| 1,938,635 | A * | 12/1933 | North | 5/427 |
| 4,607,654 | A * | 8/1986 | Duda | 135/88.12 |
| 4,770,223 | A * | 9/1988 | Ouellette | 160/302 |
| 5,503,211 | A * | 4/1996 | Engi | 160/290.1 |
| 5,505,244 | A * | 4/1996 | Thumann | 160/23.1 |
| 5,636,679 | A * | 6/1997 | Miller et al. | 160/317 |
| 5,660,144 | A * | 8/1997 | Venti | 119/416 |
| 5,690,317 | A * | 11/1997 | Sandsborg | 256/1 |
| 5,702,143 | A * | 12/1997 | Shimazaki | 296/24.43 |
| 5,718,414 | A * | 2/1998 | Deloach et al. | 256/24 |
| 6,375,165 | B1 * | 4/2002 | Sherratt et al. | 256/24 |
| 6,435,250 | B1 * | 8/2002 | Pichik et al. | 160/24 |
| 6,536,502 | B2 * | 3/2003 | Britto et al. | 160/23.1 |
| 6,575,435 | B1 * | 6/2003 | Kotzen | 256/24 |
| 6,733,204 | B1 * | 5/2004 | Paniccia | 404/6 |
| 7,082,981 | B2 * | 8/2006 | Perez, Jr. | 160/24 |

* cited by examiner

*Primary Examiner*—David Purol

(57) ABSTRACT

A retractable gate removably attached between the door frames of a dwelling having a flexible screen attached to a rotatable shaft supported within a housing. The shaft is turned by a knob to retract the screen and is locked by a spring loaded ratchet attachment.

2 Claims, 9 Drawing Sheets

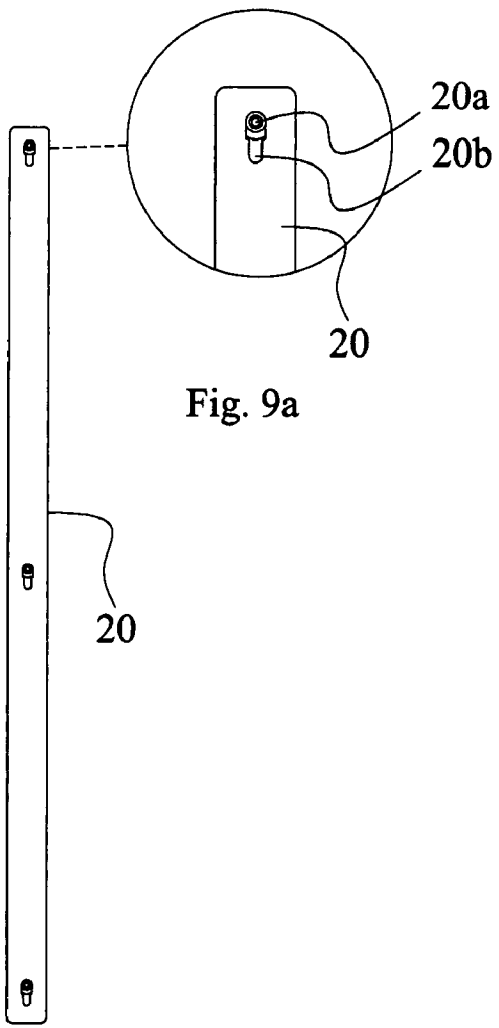
Fig. 9a
Fig. 9
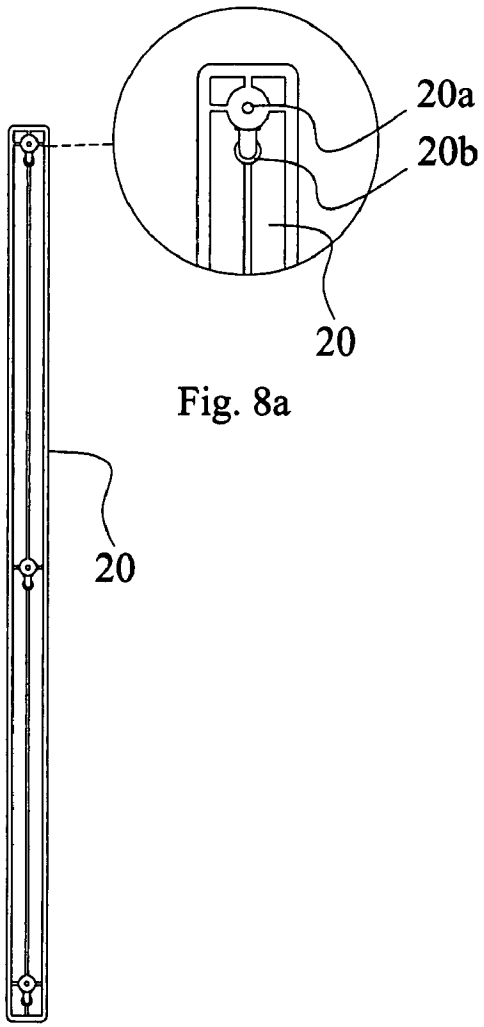
Fig. 8a
Fig. 8

RETRACTABLE GATE

BACKGROUND OF THE INVENTION

Field of the Invention

The present invention relates to removable gates for temporarily closing off doorways to restrict the movement of children or pets and, more particularly to a retractable gate removably attached between the doorframes of a dwelling or other such structure, said gate having a flexible web membrane attached to a rotatable shaft supported within a housing said shaft being turned by a knob said shaft being lockable against rotation by a spring loaded ratchet mechanism.

There is frequently a need to restrict the movement of children or pets throughout a dwelling especially in situations where potential hazards exist. Childproof gates have traditionally been used to corral children into areas where they may safely be left or in which they can be supervised. These gates have taken many forms including collapsible wooden slats or solid pieces slid into retaining channels attached to each doorjamb. Such devices are unwieldy and may themselves present pinching hazards as they are collapsed, additionally they may have insufficient height to discourage stepping over the top of them, a practice which itself has resulted in numerous accidents to adults.

SUMMARY OF THE INVENTION

The present invention is mounted to a doorway by an attachment bracket attached to each side of the doorframe. The gate device is fully wound and enclosed within a case the case is mounted on one side of the doorway. The flexible gate is affixed at the outer edge to a carrier bar which has three protruding attachment studs that are offered up to a series of slotted holes in the bracket on the opposite doorframe. The slotted holes are shaped such that the attachment studs are first pushed into a top opening allowing the stud's hemispherical head to protrude into a space within the bracket. Once the heads are inside the bracket, the carrier bar is pushed downward approximately ¼" which pushes the stud heads down into and behind the edges of the slots. This locks the studs to the bracket and effectively seals the doorway. Removal is accomplished by simply raising the carrier bar ¼" to release the studs from the slots whereupon the carrier bar can be separated from the mounting bracket. The flexible gate is then rolled back inside the case and the carrier bar is folded back around the case and attached thereto.

It is an object of the invention to provide a flexible gate contained within a case removably attached to one side of a doorway and which can be deployed by unwinding from within the case and attached to a removably attached bracket on the opposite side of the doorway.

It is a further object of the invention to retain the flexible gate within the case by securing the gate mounting shaft against rotation with a lockable ratchet and pawl means.

It is a further object of the invention to make the gate high enough that adults will not attempt to step over it and possibly injure themselves thereby.

It is a further object of the invention to provide a plurality of attachment brackets which may be mounted to multiple doorways to facilitate the deployment of the gate in a choice of locations.

It is a further object of the invention to secure the gate in place against a child's attempts to remove it, by rotating the rewind knob to tension the gate and pull the attachment studs tightly into position within the mounting bracket. It is a further object of the invention to lock the gate in position under tension by deploying the ratchet and pawl lock.

It is a further object of the invention to provide a retractable gate made from durable ABS plastic or other such suitable material which can be cleaned and which is resistant to deterioration and resilient against damage from children or pets.

It is a further object of the invention to provide a retractable gate which can be deployed in doorways or at the head or the foot of stairs.

BRIEF DESCRIPTION OF THE DRAWINGS

FIG. 8 is a rear elevational view of an attachment bracket according to the invention.

FIG. 8*a* is an inset view of a detail of an attachment bracket according to the invention.

FIG. 9 is a front elevational view of an attachment bracket according to the invention.

FIG. 9*a* is an inset view of a detail of an attachment bracket according to the invention.

DETAILED DESCRIPTION OF A PREFERRED EMBODIMENT

Referring now to the annexed drawings in which like numerals designate like and corresponding parts throughout the several views and in which the invention is designated overall by the numeral 10 and the main case rewind section is designated overall by the numeral 30 and the main case is designated by the numeral 38.

Figure 1:
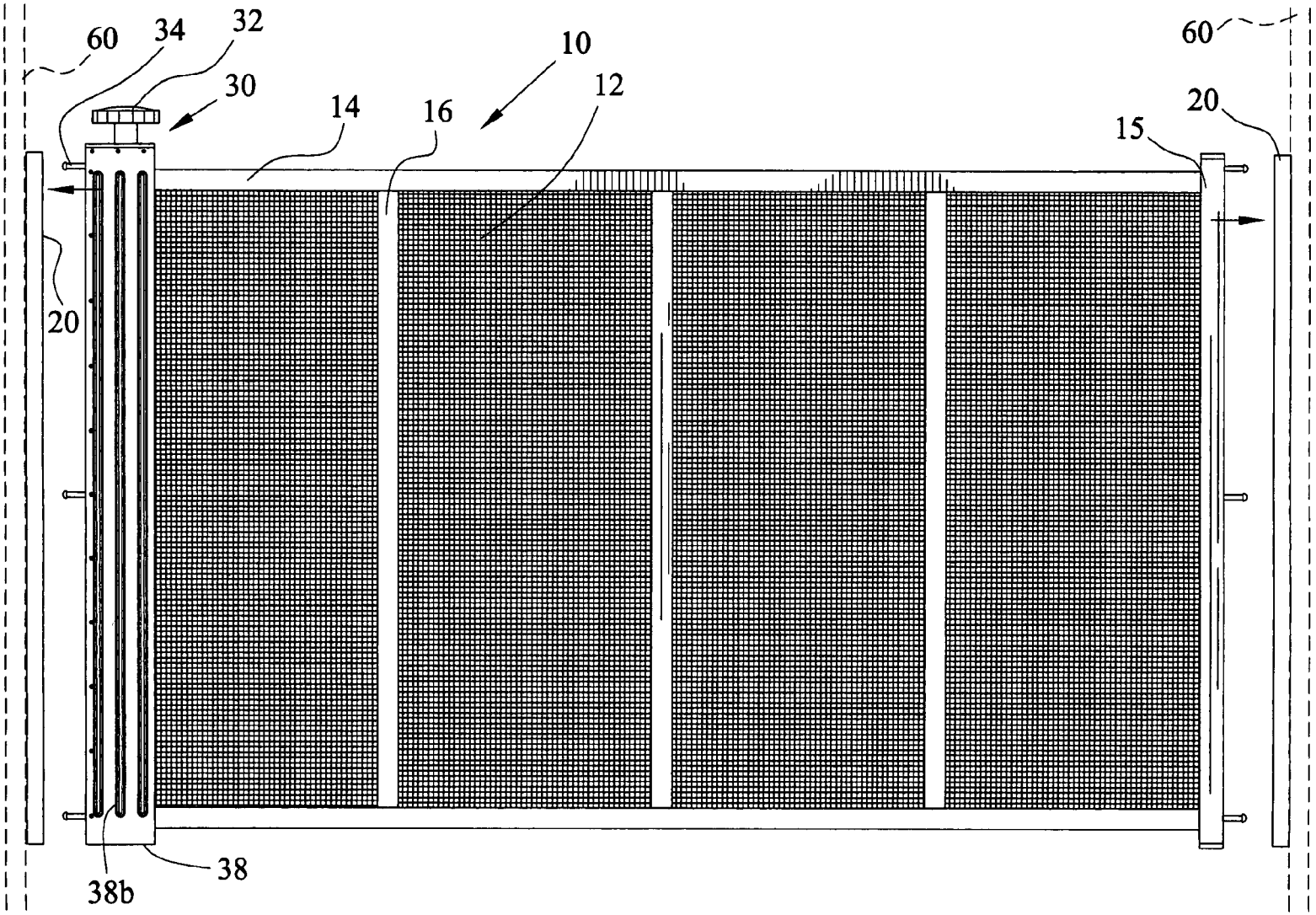
FIG. 1 is an elevational view of the assembled and deployed retractable gate according to the invention.

FIG. 1 shows the retractable gate 1 deployed from its storage position within case 30. Attachment brackets 20 are in position against doorframes 60 ready to accept studs 34. Carrier bar 15 supports flexible mesh 12 which is attached with seams 14 and supported by stiffening members 16. Rewind knob 32 is positioned above case 38 which is stiffened and reinforced by longitudinal indentations 38*b*.

Figure 2:
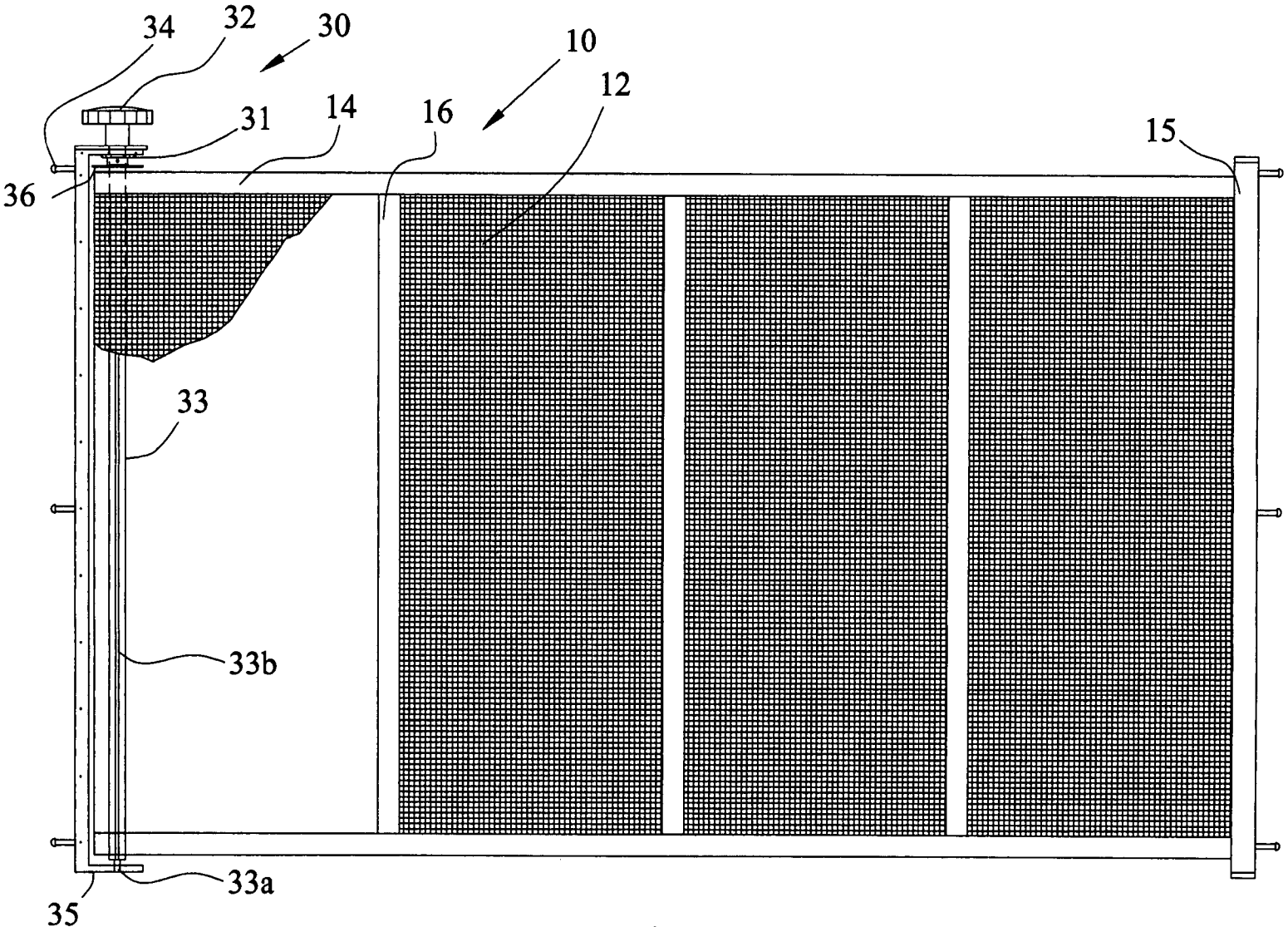
FIG. 2 is an elevational view partially in section of the assembled and deployed retractable gate according to the invention.

FIG. 2 shows the inner components main support tube 33 and groove 33*b* into which screen 12 is inserted to retain it while it is rewound by rewind knob 32. Pivot end 33*a* facilitates the retention and rotation of shaft 33.

Figure 3:
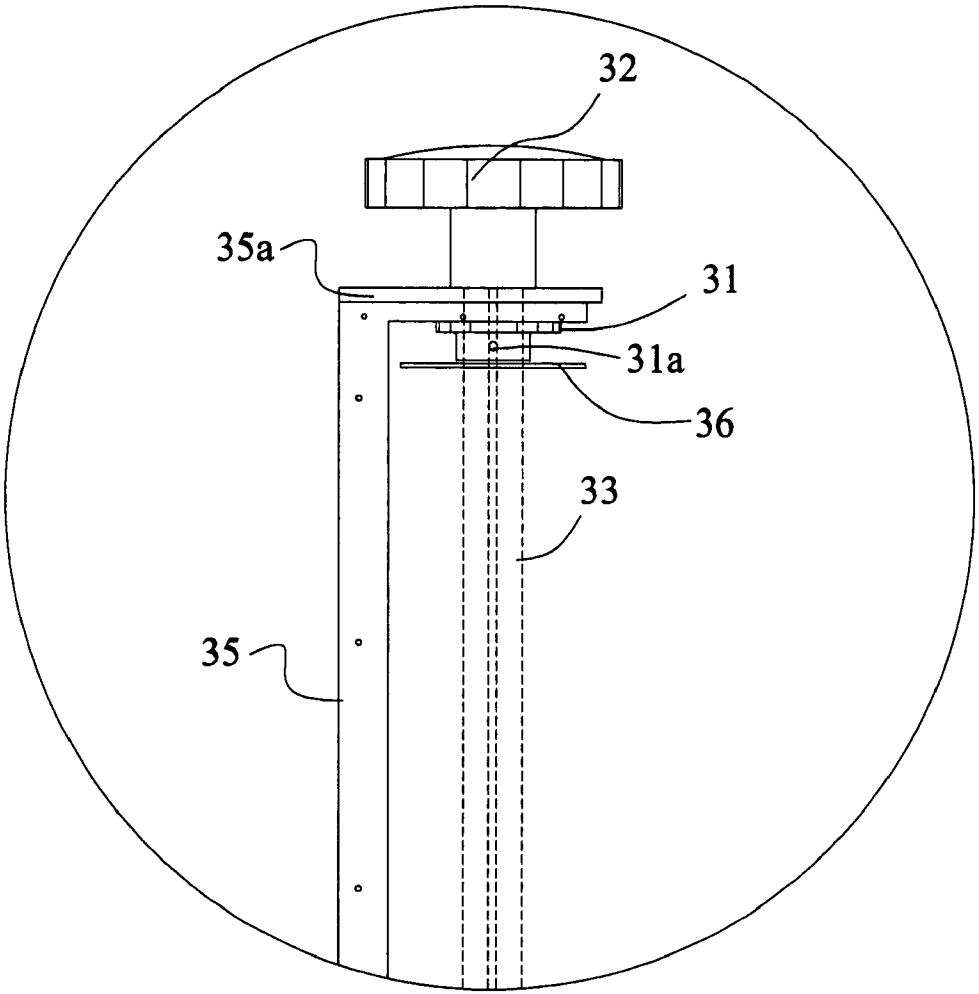
FIG. 3 is an inset elevational view partially in section of the rewind section according to the invention.
Figure 4:
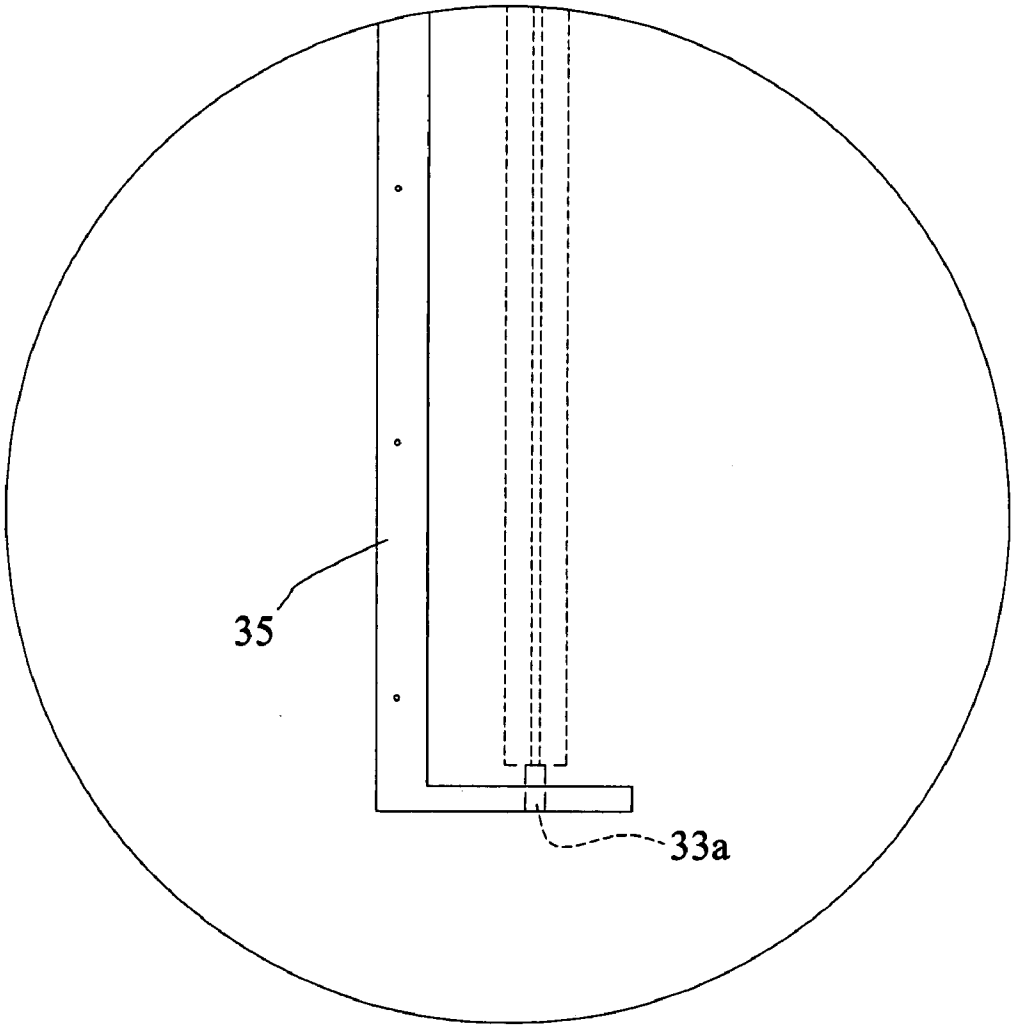
FIG. 4 is an inset elevational view partially in section of the lower pivot section according to the invention.

FIG. 3 shows case cover 35*a* supporting shaft 33, rewind knob 32, and ratchet 31 which in turn is restrained from turning by screw 31*a*. Screen upper guide 36 provides a shoulder against which seams 14 and screen 12 are evenly rewound into case 38. FIG. 3 shows in more detail pivot point 33*a* as it protrudes through rear case 35.

Figure 5:
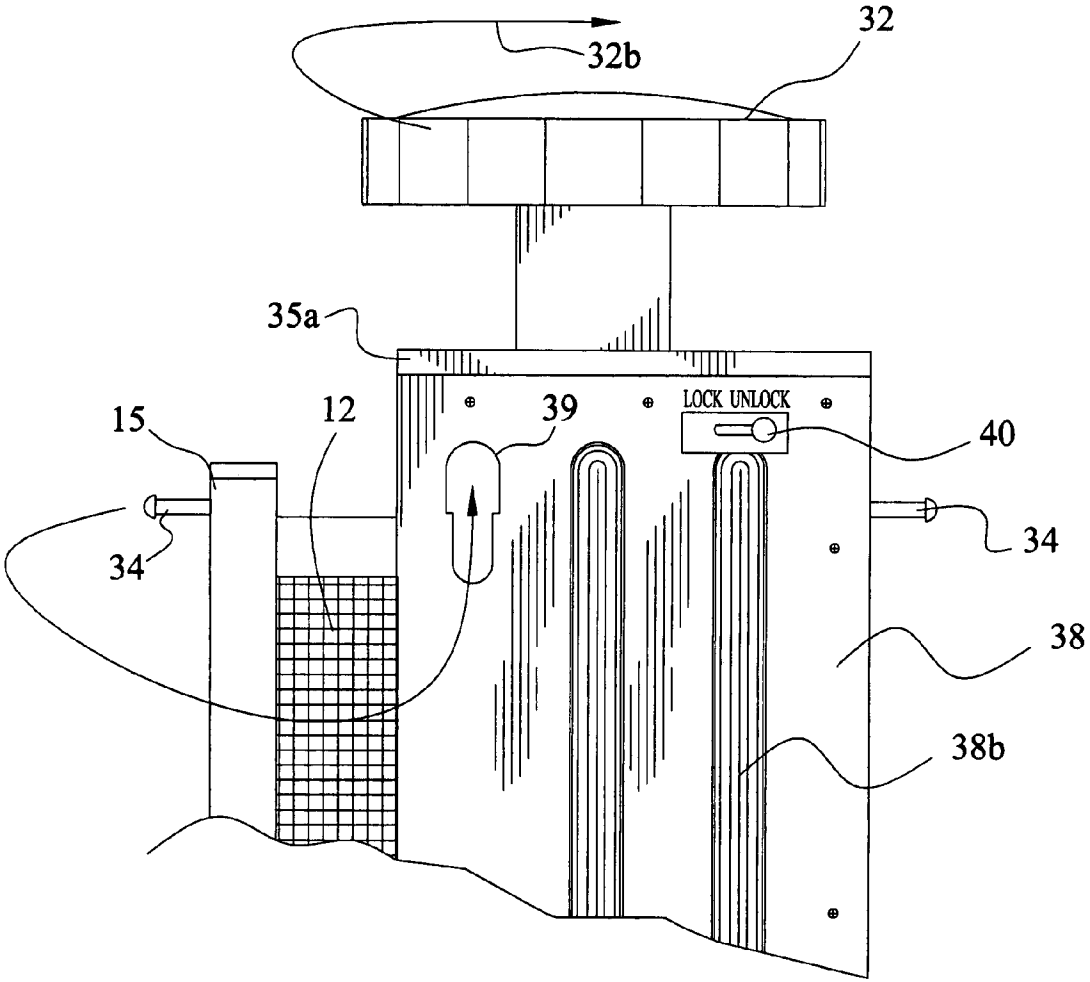
FIG. 5 is an elevational view partially in section of the assembled rewind and locking system according to the invention.

In FIG. 5, rewind knob 32 rotates in the direction of arrow 32*b* to pull screen 12 back inside case 38. Carrier bar 15 can be attached to case 38 when screen 12 is not deployed. This is accomplished by pulling the end of screen 12 around such that stud 34 can be inserted into retaining slot 39. Lock handle 40 moves pawl 41 (FIG. 7) to engage with ratchet 31.

Figure 6:
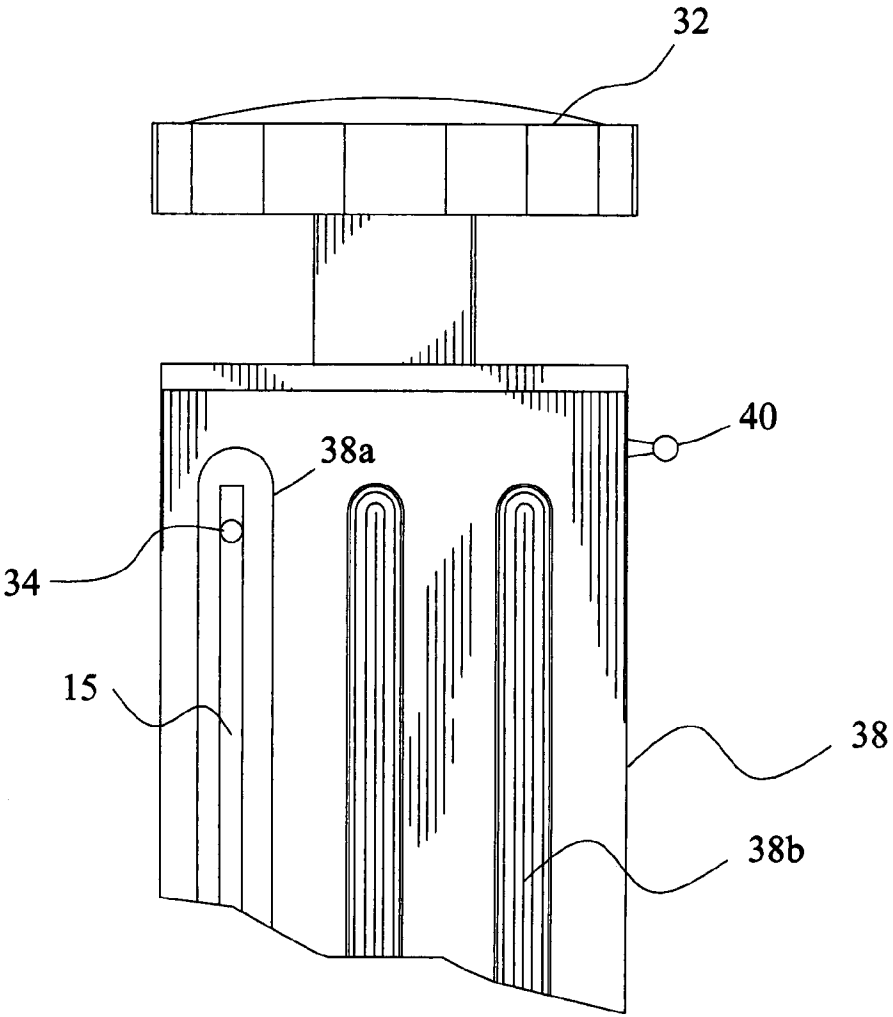
FIG. 6 a front elevational view partially in section of the assembled rewind and locking system according to the invention.

FIG. 6 shows carrier bar (and thus screen 12 attached) being accessed through slot 38*a* in the front of case 38.

Figure 7:
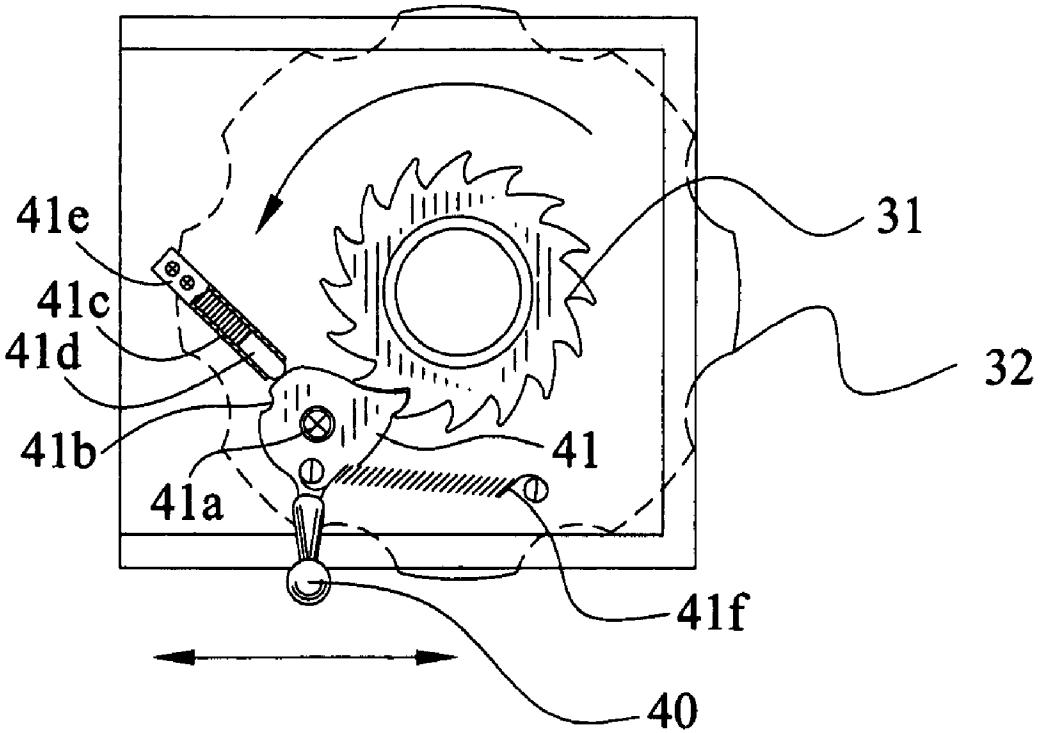
FIG. 7 is a plan view partially in section of the locking means according to the invention.

FIG. 7 shows the underside and working parts of ratchet 31 and pawl 41. As ratchet 41 is rotated counter clockwise around axis 41*a*, pawl 41 is able to pass over the teeth of ratchet 31. Tension is maintained by spring 41*f*. In the locked position (shown), ratchet 31 cannot rotate clockwise which retains screen 12 in position and maintains pressure upon the heads of studs 34 so they may not be easily removed by a child. By its nature, the ratchet/pawl lock must be slightly rotated in order for the unlocked position to be reached whereupon lever 40 can be moved to disengage pawl 41. The unlocked position is retained by spring stop assembly 41*e* wherein spring 41*c* pushes plunger 41*d* outward to engage with groove 41*b*. This assembly provides a tactile "click" signifying that the unit is engaged.

Figure 10A:
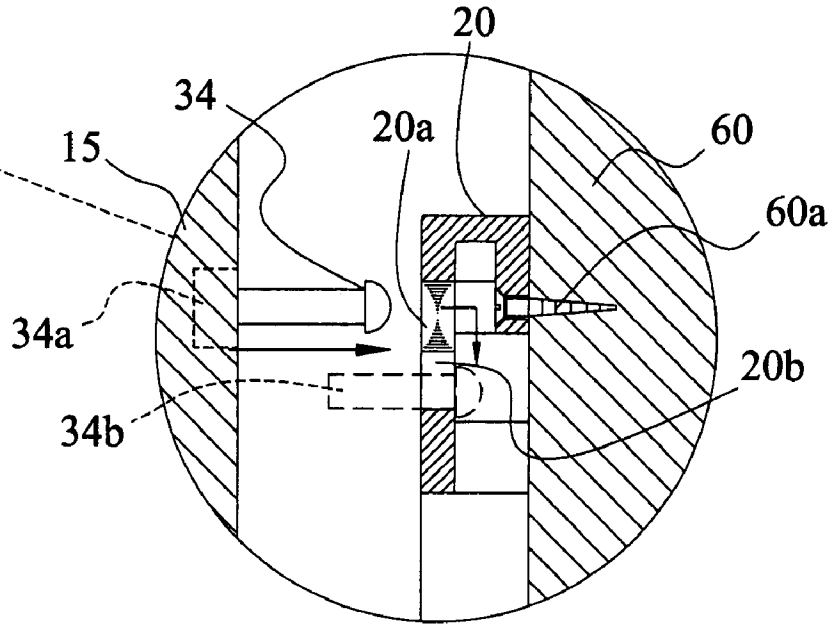
FIG. 10*a* is an inset view of a detail of an attachment bracket according to the invention.
Figure 10:
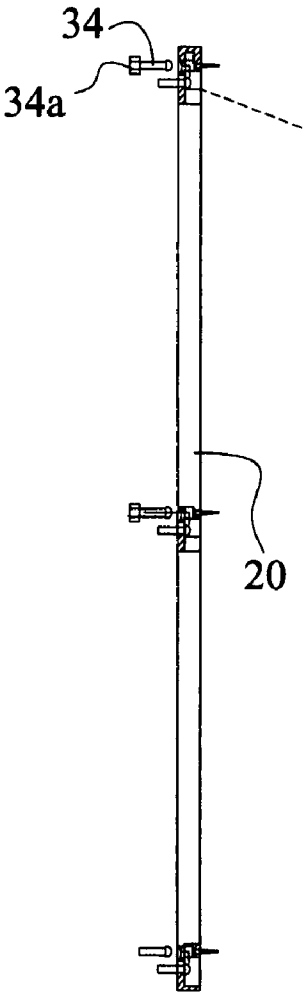
FIG. 10 is an elevational view partially in section of an attachment bracket according to the invention.

FIGS. 8–9*a* show both sides of brackets 20 and FIGS. 10 and 10*a* show details of stud 34 being attached to carrier 15 by nut 34*a*. Stud 34 is inserted into hole 20*a* in bracket 20 which is attached to wall 60 by screw(s) 60*a*. As stud 34 enters opening 20*a* and its head is inside the opening, carrier 15 is pushed downward and repositions stud 34 in position 34*b* behind edge 20*b* which removably locks it in place for deployment of the invention screen.

What is claimed is:

1. A retractable gate for removably attaching to doorways comprising:

a case, said case having a plurality of indentations formed therein, and a plurality of studs mounted thereon, a support shaft rotatably mounted within said case, said shaft having rotating means mounted thereon and having a mounting groove formed along the length of said shaft, a flexible screen having a first end and a second end, said first end being mounted within said support shaft mounting groove, said second end having a carrier bar mounted thereon, said carrier bar having a plurality of mounting studs mounted thereon, a top and bottom seam attached to said screen and a plurality of stiffening members vertically attached to said top and bottom seams of said flexible screen, and a first and second attachment bracket, said first attachment bracket being attached to a first door frame, and a second attachment being attached to a second door frame, said attachment brackets having a plurality of mounting holes formed therein said rotating means comprises a rewind knob and a ratchet secured to said support shaft for rotation therewith, a pawl having a groove and being pivotally mounted within said case and biased by a tension spring into engagement with said ratchet, a lock handle for selectively moving said pawl in and out of engagement with said ratchet, a spring biased plunger for engaging the groove of said pawl so as to maintain the pawl in an unlocked position.

2. The retractable gate of claim 1 wherein said case and attachment brackets are made from ABS plastic.

* * * * *